US006469285B2

(12) United States Patent
Inami

(10) Patent No.: US 6,469,285 B2
(45) Date of Patent: Oct. 22, 2002

(54) AUTOMATIC TEMPERATURE CONTROL DEVICE

(75) Inventor: Atsushi Inami, Kanagawa-ken (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 09/875,183

(22) Filed: Jun. 7, 2001

(65) Prior Publication Data

US 2001/0050276 A1 Dec. 13, 2001

(30) Foreign Application Priority Data

Jun. 13, 2000 (JP) ..... 2000-176756

(51) Int. Cl.[7] ..... B01L 7/00; F27D 1/18

(52) U.S. Cl. ..... 219/521; 219/391; 219/385; 219/400; 126/340; 435/809

(58) Field of Search ..... 219/521, 391, 219/392, 400, 385; 126/190, 192, 332, 340; 435/809

(56) References Cited

U.S. PATENT DOCUMENTS 1,023,646 A * 4/1912 Herndon ..... 126/340
3,618,734 A * 11/1971 Khan ..... 435/809
4,683,871 A * 8/1987 Salvi ..... 126/340
4,862,792 A * 9/1989 Lerma, Jr. ..... 126/340
4,892,085 A * 1/1990 Salvi ..... 126/340
5,061,448 A * 10/1991 Mahe et al. ..... 435/809
5,459,300 A * 10/1995 Kasman ..... 435/809
5,681,492 A * 10/1997 Van Praet ..... 219/400

* cited by examiner

*Primary Examiner*—Joseph Pelham
(74) *Attorney, Agent, or Firm*—Armstrong, Westerman & Hattori, LLP

(57) ABSTRACT

An automatic temperature control device comprises a reaction chamber for housing a vessel, a tray for supporting the vessel, a temperature control part for controlling at least the temperature in the reaction chamber, a transfer means for slidably moving the tray such that the tray may freely enter or withdraw from the reaction chamber, a first cover part for closing up the reaction chamber tightly when the tray is made to enter the reaction chamber by the transfer means, a second cover part for closing up the reaction chamber tightly when the tray is made to withdraw from the reaction chamber by the transfer means, and first and second magnets for holding the second cover part in a tightly closed-up state, wherein the tray for supporting the vessel is allowed to move slidably in linkage with the pivotal motion of the cover for pivoting the cover and also making the vessel to enter or withdraw from the reaction chamber in one operation.

5 Claims, 6 Drawing Sheets

AUTOMATIC TEMPERATURE CONTROL DEVICE

BACKGROUND OF THE INVENTION

1. Field of the Invention

This invention relates to an automatic temperature control device used for automatic analysis accompanied with a chemical reaction in the field of clinical medicine, biochemistry and pharmaceutics or the like.

2. Description of the Prior Art

In analysis accompanied with a chemical reaction in the field of clinical medicine, biochemistry and pharmaceutics or the like, there is a need for the control of temperature of a mixture of samples and reagents or the like for a certain period of time at a predetermined temperature for allowing the samples to react with the reagents or the like. On the other hand, a vessel such as a micro plate equipped with a plurality of wells, for instance, is used for allowing a plurality of samples to react with the reagents or the like. For that reason, the vessel such as the micro plate needs to be subjected to the control of temperature.

In the prior art, the temperature of the vessel is controlled manually. Such temperature control is performed, for instance, by a method of pivoting manually a cover adopting a pivoting mechanism such as a hinge to put a vessel in a reaction chamber of a temperature control device for the control of temperature for a certain period of time after heating the reaction chamber up to a predetermined temperature with a heating means such as a heater, and thereafter opening the cover manually again to take out the vessel from the reaction chamber.

Since the temperature control device in the prior art requires the manual operations for pivoting the cover and also for making the vessel to enter or withdraw from the reaction chamber, these manual operations present a problem for the automation of the temperature control device.

The pivoting mechanism such as the hinge for pivoting the cover of the reaction chamber and a link mechanism or the like for making the vessel to enter or withdraw from the reaction chamber are considered to be available for the automation of the temperature control device. However, since both the mechanism for pivoting the cover and the mechanism for making the vessel to enter or withdraw from the reaction chamber are required for the automation, there is a need for a complicated mechanism, resulting in an increase in device size.

Further, since the reaction chamber is exposed to the outside air when the cover is opened through the hinge, the temperature in the reaction chamber varies every pivoting operation of the cover, resulting in a difficulty in maintaining the inside of the reaction chamber at a predetermined temperature. Besides, once a drop in temperature occurs, it takes time for heating, resulting in a problem of the need for longer time for analysis.

OBJECT AND SUMMARY OF THE INVENTION

It is an object of the present invention to automate a temperature control device, more specifically, to automate the operation of making a vessel to enter or withdraw from a reaction chamber held in a tightly closed-up state.

The present invention is to automate the operation of making a vessel to enter or withdraw from a reaction chamber held in a tightly closed-up state by making it possible to pivot a cover and also make the vessel to enter or withdraw from the reaction chamber in one operation. This automation is realized by allowing a tray for supporting the vessel to move slidably in linkage with the pivotal motion of the cover, enabling the cover to close and open and also the vessel to enter or withdraw from the reaction chamber in one operation.

To realize the automation, an automatic temperature control device according to the present invention comprises a reaction chamber for housing a vessel, a tray for supporting the vessel, a temperature control part for controlling the temperature at least in the reaction chamber, a transfer means for moving slidably the tray such that the tray may freely enter or withdraw from the reaction chamber, a first cover part for closing up the reaction chamber tightly when the tray is made to enter the reaction chamber by the transfer means, a second cover part for closing up the reaction chamber tightly when the tray is made to withdraw from the reaction chamber by the transfer means, and a holding part for holding the second cover part in a tightly closed-up state.

The transfer means slides the tray relatively to the reaction chamber such that the vessel supported with the tray may freely enter or withdraw from the reaction chamber, while moving the first and second cover parts for closing up tightly and opening the reaction chamber.

When making the vessel to enter the reaction chamber, the tray is caused to move into the reaction chamber and also the reaction chamber is closed up tightly with the first cover part. On the other hand, when making the vessel to withdraw from the reaction chamber, the tray is caused to move from the reaction chamber and also the reaction chamber is closed up tightly with the second cover part.

The holding part moves the second cover part in linkage with withdrawal of the tray, and besides, holds the reaction chamber in the tightly closed-up state irrespectively of the location of the tray in the absence of the vessel. The holding part may be composed of a first magnet and a second magnet both provided on the second cover part side. The first magnet is adapted to attract the end of the vessel for the linkage with withdrawal of the tray, while the second magnet is adapted to attract the opposite inner wall part of the automatic temperature control device for holding the second cover part in the tightly closed-up state.

According to the present invention, the automation of the temperature control device is realized by allowing the tray for supporting the vessel to move slidably in linkage with the pivotal motion of the cover, enabling the cover to close and open and also the vessel to enter or withdraw from the reaction chamber in one operation.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENT

Figure 1:
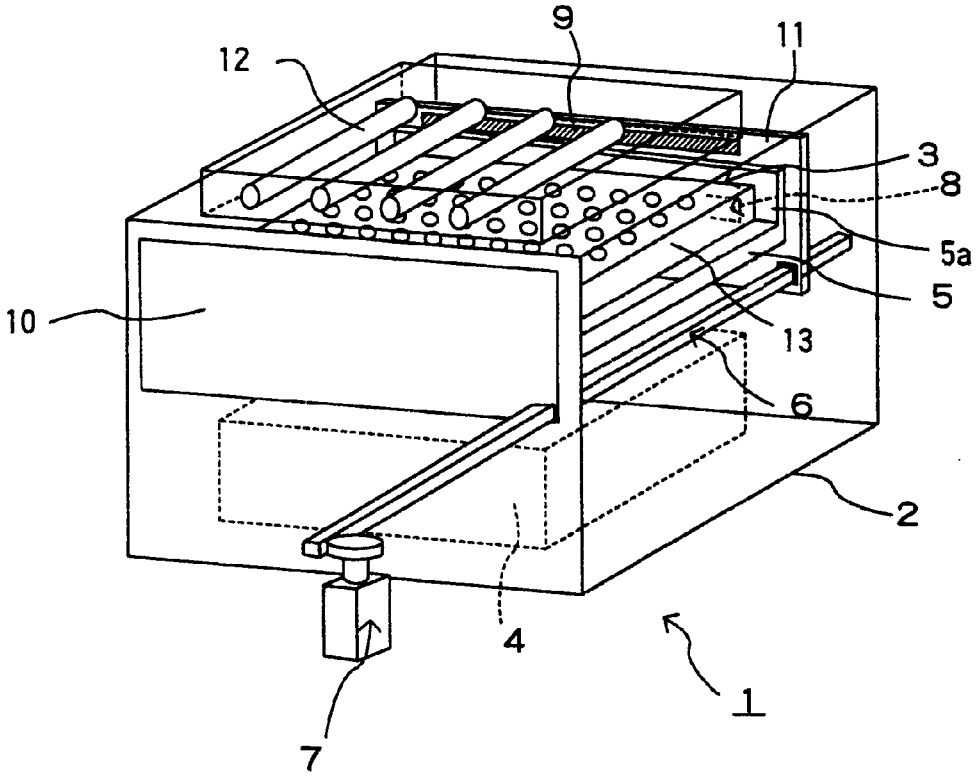
FIG. 1 is a perspective view showing one embodiment of an automatic temperature control device according to the present invention.
Figure 2A:
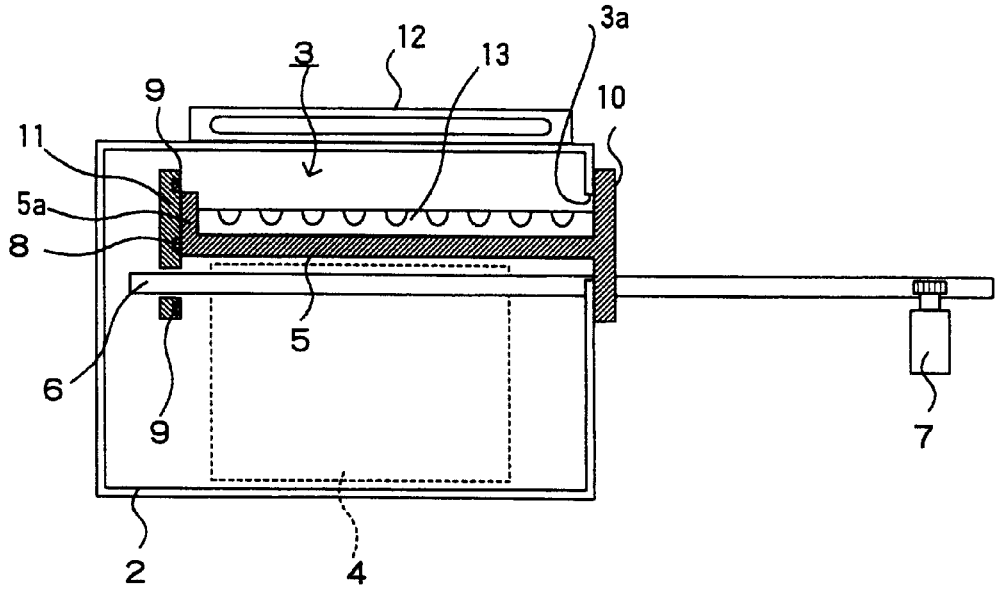
FIG. 2A is a vertical sectional view of the automatic temperature control device of FIG. 1.
Figure 2B:
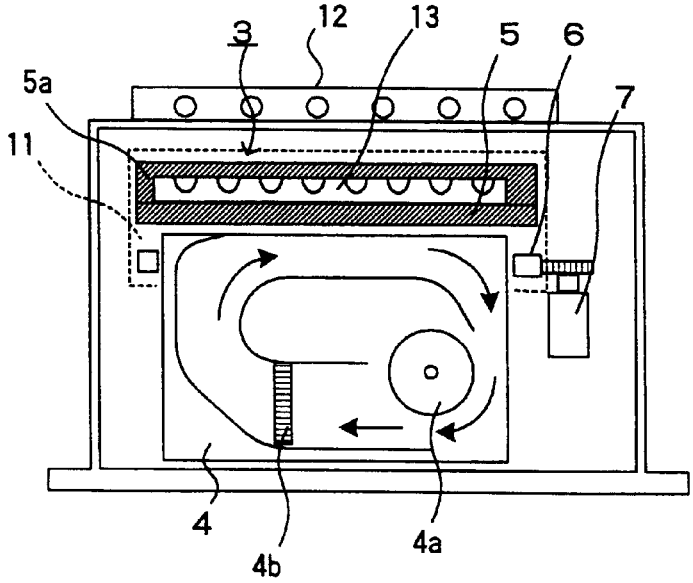
FIG. 2B is a transverse cross-section of the automatic temperature control device of FIG. 1.

An automatic temperature control device 1 is applied to control the temperature of a vessel 13 such as a micro plate and a vial housed in a reaction chamber 3 for a certain period of time. As shown in FIGS. 1 to 2B, the automatic temperature control device 1 has a chamber 2 including the reaction chamber 3 and a temperature control chamber 4 for controlling the reaction chamber 3 to hold at a predetermined temperature. Further, the chamber 2 has UV lamps 12 on the outside of its upper part for irradiating UV wavelength light to the reaction chamber 3.

Further, a tray 5 can be moved to enter or withdraw from the reaction chamber 3. The vessel 13 such as the micro plate and the vial is placed on the tray 5, which is then subjected to the control of temperature for a certain period of time in the reaction chamber 3 by the use of the temperature control chamber 4.

A drive means 7 such as a feed screw mechanism and a belt mechanism may be applied to operate the transfer means 6 such as a slide member carrying the tray 5 in order to move the tray 5 mounted with the vessel 1 straight (horizontally in FIG. 2) from the inside to the outside of the reaction chamber 3 or in the reverse direction through an opening part 3*a* of the reaction chamber.

The reaction environment of the vessel 13 housed in the reaction chamber 3 is controlled through the control of temperature by the temperature control chamber 4, together with the irradiation of UV wavelength light from the UV lamps 12. The temperature control chamber 4 is arranged below the reaction chamber 3, while the UV lamps 12 are arranged above the reaction chamber 3.

As shown in FIG. 2B, the temperature control chamber 4 includes a fan 4*a* for making the circulation of air in the chamber 2 and a heater 4*b* for heating the circulating air. The heated air circulating in the chamber 2 is applied to control the temperature of the reaction chamber 3.

Each UV lamp 12 is to irradiate UV wavelength light to the vessel 13 housed in the reaction chamber 3 through a window formed in an upper wall of the chamber 2 to permit transmission of at least UV wavelength light.

The tray 5 has, at one end facing the opening part 3*a* of the reaction chamber 3, a first cover part 10 sized and shaped enough to cover the opening part 3*a*, and has, at the other end, an end part 5*a* in the shape of a vertical wall.

At the rear of the end part 5*a* of the tray 5 in the chamber 2, a second cover part 11 is arranged in the state of being carried by the transfer means 6 (or a slide bar united therewith). The second cover part 11 has a first magnet 8 mounted in a location corresponding to the end part 5*a* of the tray 5. FIG. 2A shows the state in which the second cover part 11 is attracted to the: end part 5*a* of the tray 5 by the first magnet 8 mounted in the location corresponding to the end part 5*a* of the tray 5. Similarly to the first cover part 10, the second cover part 11 is also shaped and sized enough to cover the opening part 3*a* of the tray 5. The second cover part 11 further has a plurality of second magnets 9 mounted in the front face in locations around the outside of an area corresponding to the opening part 3*a* of the tray 5.

Figure 4:
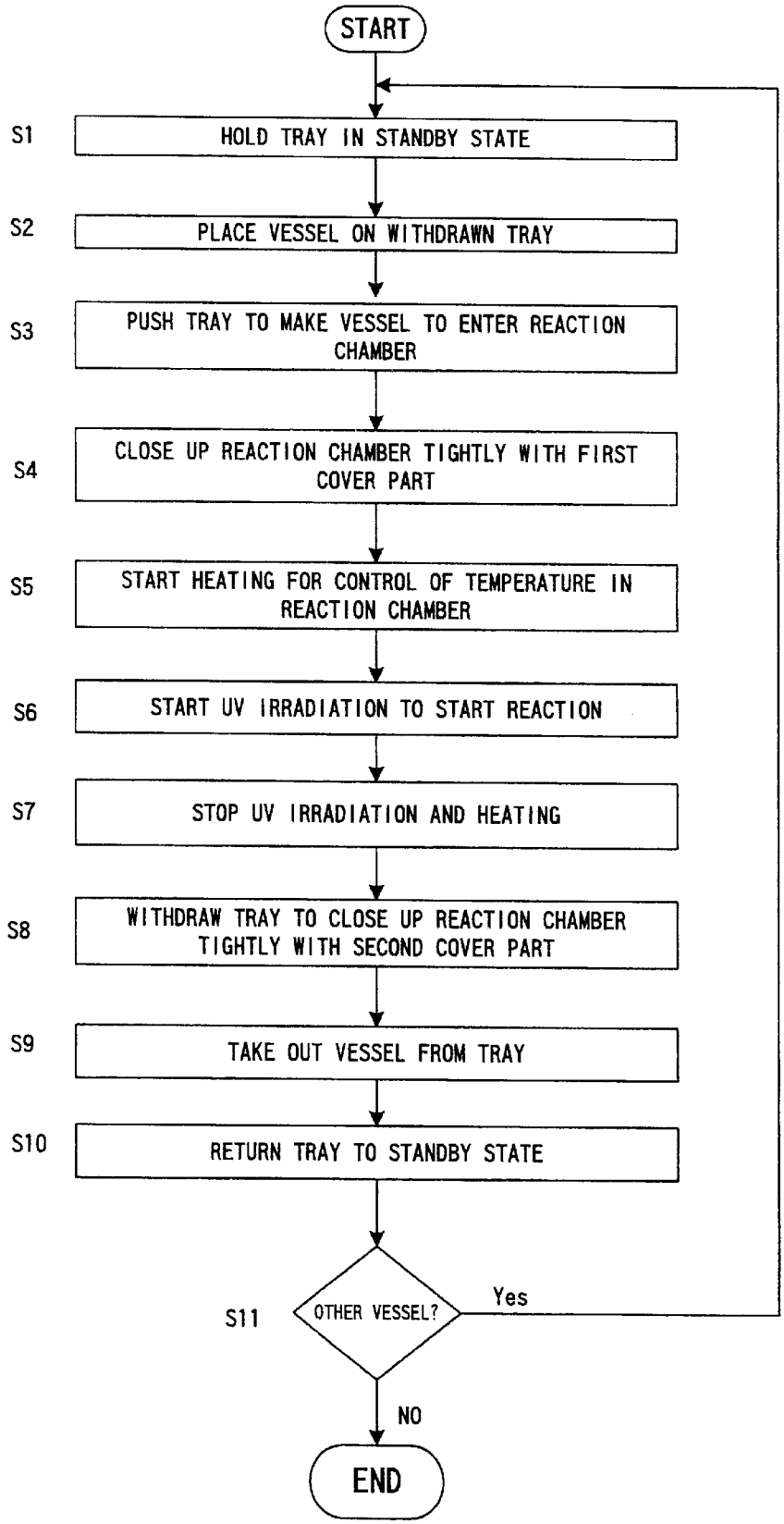
FIG. 4 is a flow chart for explaining the operations (loading of a vessel into a reaction chamber, control of temperature in the reaction chamber, UV irradiation to the Vessel and take-out of the vessel from the reaction chamber) of the automatic temperature control device of FIG. 1.

A description will now be given of the procedure of the operations of placing the vessel 13 on the tray 5 located on the outside of the reaction chamber 3 (that is, placed in the standby state) to house the vessel 13 in the reaction chamber 3 by moving the tray 5 toward the reaction chamber 3, and then taking out the vessel 13 and the tray 5 from the reaction chamber 3 to the outside after subjecting the vessel 13 housed in the reaction chamber 3 to heating and UV irradiation with reference to the flow chart of FIG. 4.

Figure 5A:
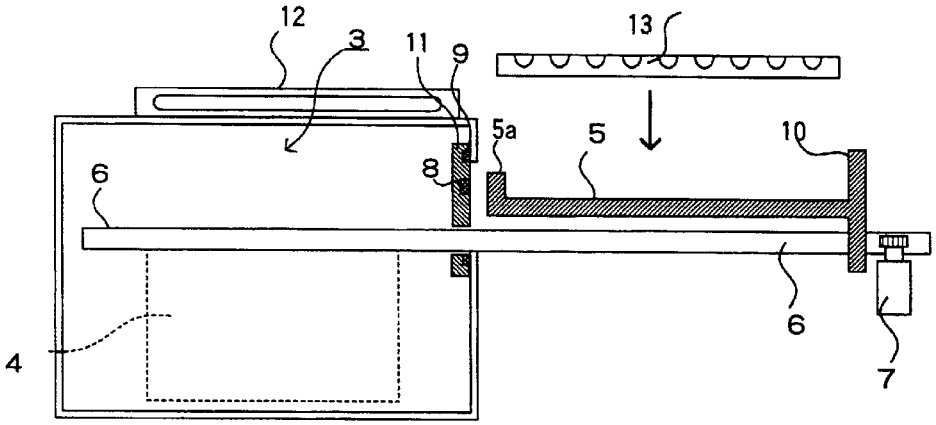
FIGS. 5A to 5C are sectional views for illustrating each stage of one operation (loading of a vessel into a reaction chamber) of the automatic temperature control device of FIG. 1 respectively.
Figure 5B:
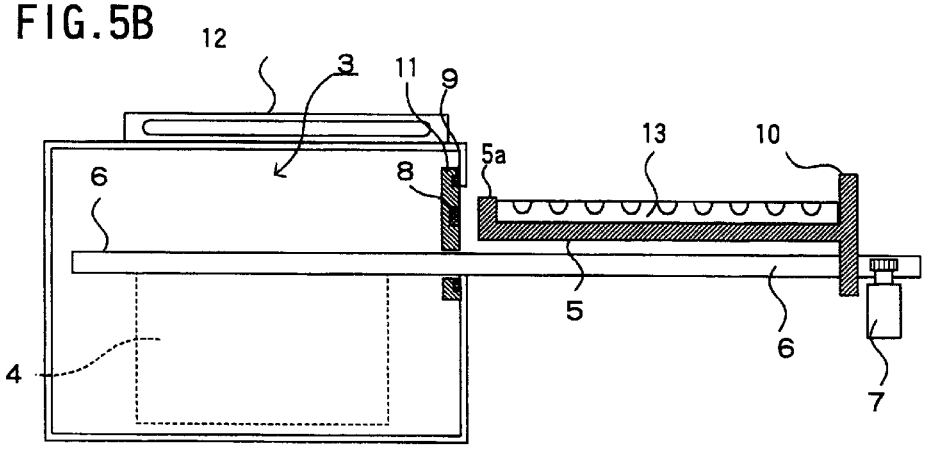

Firstly, the vessel 13 is placed on the tray 5 located on the outside of the reaction chamber 3 (Steps S1, S2), as shown in FIGS. 5A and 5B. In this place, since the opening part 3*a* of the reaction chamber 3 is closed up by the second cover part 11 in consequence of the previous operation of taking out the tray 5 (Step S8 which will be described later), the inside of the reaction chamber 3 is held in the tightly closed-up state.

Subsequently, the tray 5 is moved toward the reaction chamber 3 by driving the drive means 7 to operate the transfer means 6 (Step S2). The end part 5*a* of the tray 5 for the duration of the movement pushes the second cover part 11 attracted to the inner wall surface around the opening part 3*a* of the reaction chamber 3 to the rear to disengage the second cover part 11 from the inner wall surface of the reaction chamber 3 against the attraction force caused by the second magnets 9. Then, the second cover part 11 disengaged from the inner wall surface of the reaction chamber 3 is attracted to the end part 5*a* of the tray 5 by the first magnet 8.

Figure 3A:
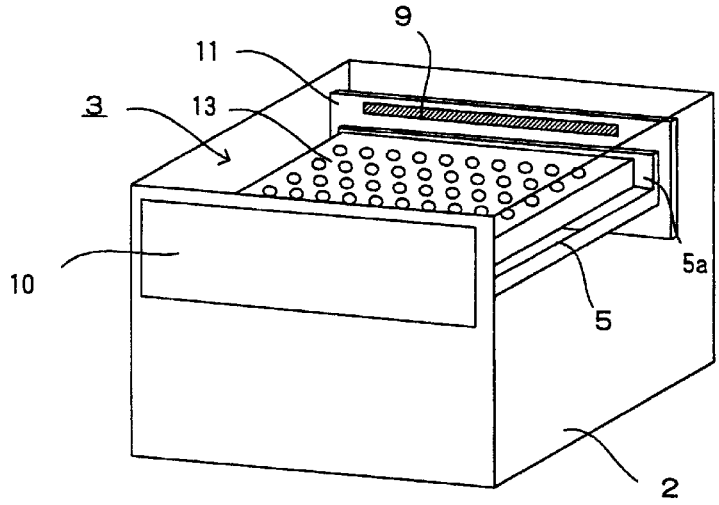
FIGS. 3A to 3C are perspective views for illustrating each stage of one operation (take-out of a vessel from a reaction chamber) of the automatic temperature control device of FIG. 1 respectively.
Figure 5C:
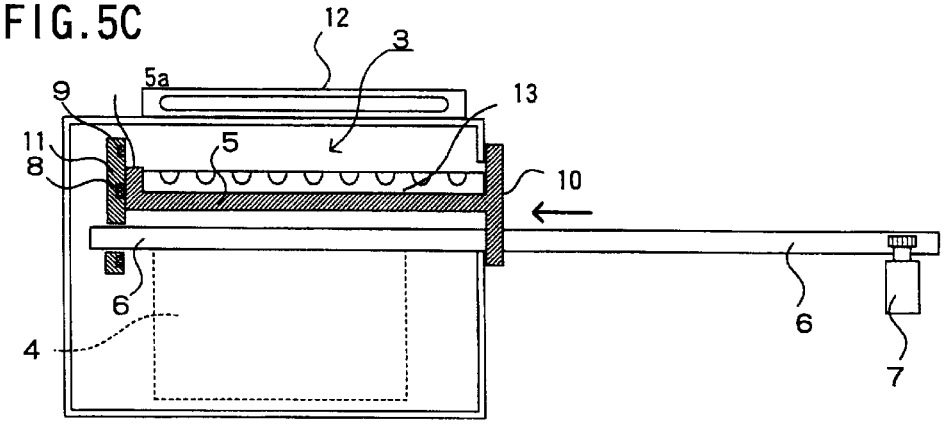

Then, the tray 5 is moved further rearward in the reaction chamber 3, while attracting the second cover part 11 to the end part 5*a* of the tray 5, until the first cover part 10 of the tray 5 makes contact with the outer wall surface around the opening part 3*a* of the reaction chamber 3. Then, when the first cover part 10 of the tray 5 makes contact with the outer wall surface of the reaction chamber 3, the opening part 3*a* of the reaction chamber 3 is covered with the first cover part 10 as shown in FIG. 5C, and as a result, the reaction chamber 3 is held in the tightly closed-up state (Step S4C). In consequence, the vessel 13 placed on the tray 5 is housed in the tightly closed-up reaction chamber 3 as shown in FIG. 3A.

Subsequently, the vessel 13 is subjected to heating by operating the fan 4*a* and the heater 4*b* in the temperature control chamber 4 to control the inside of the reaction chamber 3 so as to hold at a predetermined temperature, while the UV wavelength light is irradiated toward the vessel 13 by lighting the UV lamps 12 (Steps S5, S6). Heating of the vessel 13 and irradiation of UV wavelength light thereto are stopped after the continuation of heating and irradiation for a predetermined period of time (Step S7).

Figure 3B:
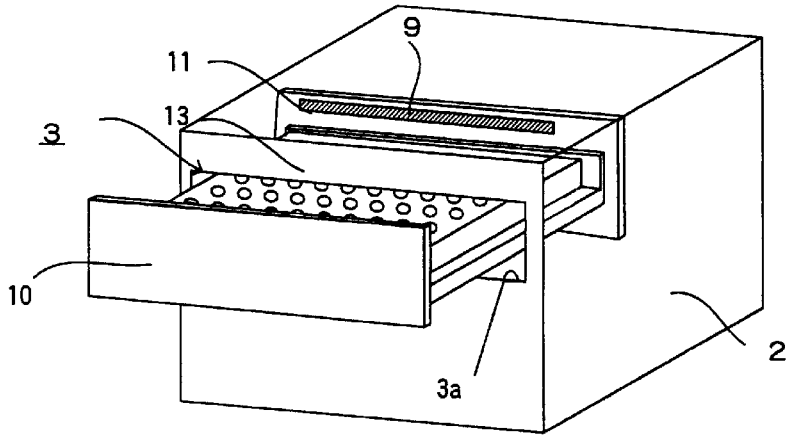
Figure 6A:
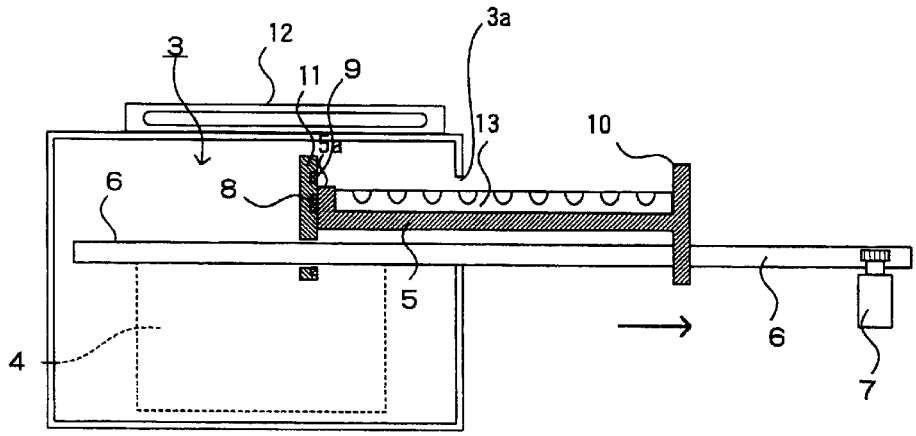
FIGS. 6A to 6C are sectional views for illustrating each stage of one operation (take-out of a vessel from a reaction chamber) of the automatic temperature control device of FIG. 1 respectively.

Subsequently, the tray 5 is moved toward the opening part 3*a* of the reaction chamber 3 by operating the transfer means 6 in the take-out direction by the drive means 7 so as to take out the tray 5 mounted with the vessel 13 from the reaction chamber 3. In this place, the second cover part 11 is moved while being attracted to the tray 5 by the attraction force of the first magnet 8 as it is, as shown in FIG. 6A. FIG. 3B shows a state in which the tray 5 is withdrawn part of the way from the reaction chamber 3.

Figure 6B:
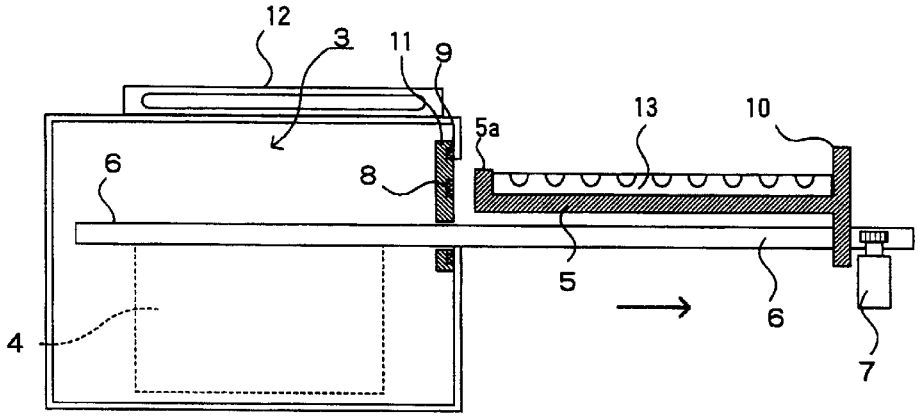

Whenever the tray 5 is withdrawn from the reaction chamber 3 to the outside completely in consequence of the movement of the tray 5 further from the location shown in FIGS. 3B and 6A in the take-out direction, the second cover part 11, which has been moved together with the tray 5 while being attracted to the end part 5*a* of the tray 5 up to now, strikes against the inner wall surface around the opening part 3*a* of the reaction chamber 3, resulting in a prevention of the second cover part 11 from its further movement. As a result, the second cover part 11 is disengaged from the end part 5*a* of the tray 5 continuing its further movement: and is then attracted to the inner wall surface around the opening part 3*a* of the reaction chamber 3 by the attraction force of the second magnets 9, as shown in FIG. 6 (Step S8). In consequence, since the opening part 3*a* of the reaction chamber 3 is covered with the second cover part 11, the reaction chamber 3 is held in the tightly closed-up state.

Figure 3C:
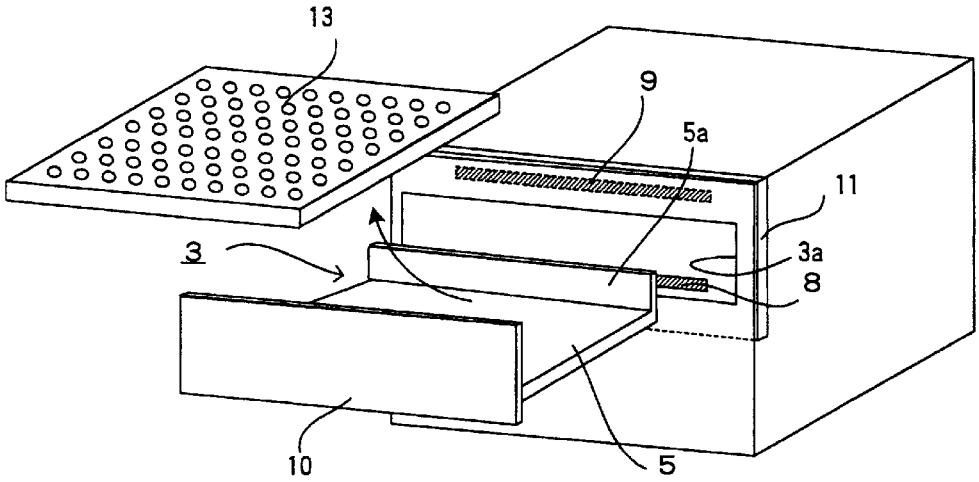
Figure 6C:
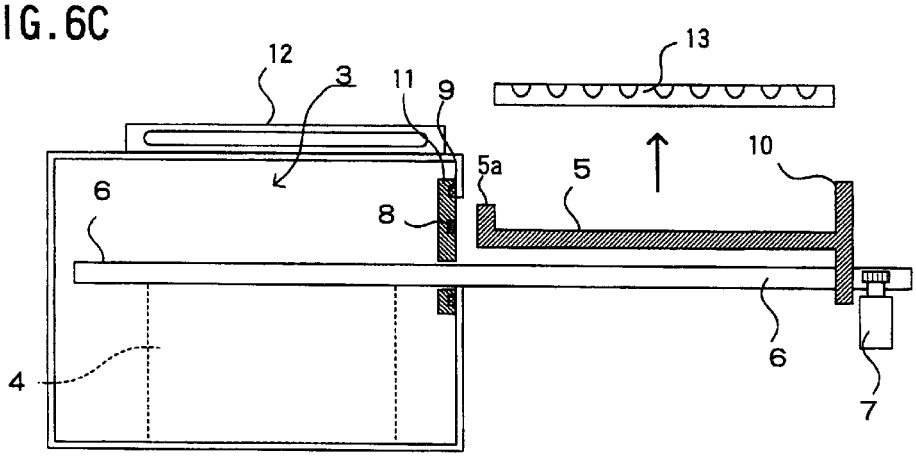

On the other hand, the tray 5, which has left the second cover part 11 behind by disengagement, is stopped after being further moved somewhat forwards, and the vessel 13 is taken out from the tray 5 as shown in FIGS. 3C and 6C (Step S9). In this place, the second cover part 11 keeps the opening part 3*a* of the reaction chamber 3 closed up. Thus, since the tightly closed-up state of the reaction chamber 3 can be held even after take-out of the tray 5 from the reaction chamber 3, it is possible to hold the temperature in the reaction chamber 3.

After take-out of the vessel 13 from the tray 5, the tray 5 is placed in the standby state (Step S10). The tray 5 in the standby state may be located on the outside of the reaction chamber 3 in the withdrawn state as it is or may be housed in the reaction chamber 3.

As described in the foregoing, according to the present invention, the tray 5 mounted with the vessel 13 can be moved straight through the opening part 3*a* of the reaction chamber in linkage with the pivotal motion of the cover for covering the opening part 3*a* to close up the reaction chamber 3 tightly. Thus, it is possible to pivot the cover and also make the vessel to enter or withdraw from the reaction chamber in one operation automatically.

What is claimed is:

1. an automatic temperature control device, comprising:

a reaction chamber for housing a vessel;

a tray for supporting the vessel;

a temperature control part for controlling at least the temperature in the reaction chamber;

a transfer means for moving said tray such that said tray may freely enter or withdraw from the reaction chamber;

a first cover part for closing up the reaction chamber tightly when said tray is made to enter the reaction chamber by said transfer means;

a second cover part for closing up the reaction chamber tightly when said tray is made to withdraw from the reaction chamber by said transfer means; and a magnetized holding part for holding the reaction chamber in a tightly close-up state by moving said second cover part.

2. An automatic temperature control device, comprising:

a reaction chamber having an opening part in one wall portion;

a tray, on which a vessel is placed; and a transfer means for moving said tray from the outside into the reaction chamber through said opening part or from the reaction chamber to the outside through said opening part;

wherein said tray has a first cover part at one end in the direction of movement and has, at the other end, an attraction end part capable of attracting a second cover part located in the reaction chamber by a first attraction means provided at the second cover part; and When loading said tray into the reaction chamber, the first cover part of the tray closes up the opening part of the reaction chamber, while, when taking out said tray loaded into the reaction chamber to the outside, the second cover part attracted to the attraction end part of the tray strikes against the inner wall surface around the opening part of the reaction chamber to make disengagement from the attraction end part, and is then attracted to the inner wall surface around the opening part of the reaction chamber by a second attraction means provided at the second cover part to close up said opening part.

3. An automatic temperature control device according to claim 2, wherein said transfer means includes a slide member capable of moving the tray in one straight direction.

4. An automatic temperature control device according to claim 3, wherein said second cover part is supported with said slide member.

5. An automatic temperature control device according to claim 2, wherein the first and second attraction means provided at said second cover part include a permanent magnet.

* * * * *